United States Patent [19]

Forberg et al.

[11] Patent Number: 4,547,034

[45] Date of Patent: Oct. 15, 1985

[54] DEVICE FOR CONNECTING INSULATED WIRES TO TWIN-TERMINAL CONTACT ELEMENTS

[75] Inventors: Horst Forberg; Bernd Delakowitz, both of Berlin, Fed. Rep. of Germany

[73] Assignee: Krone GmbH, Berlin, Fed. Rep. of Germany

[21] Appl. No.: 501,129

[22] Filed: Jun. 6, 1983

Related U.S. Application Data

[63] Continuation-in-part of Ser. No. 235,432, Feb. 17, 1981, abandoned.

[30] Foreign Application Priority Data

Jun. 11, 1980 [DE] Fed. Rep. of Germany .....: 3021798

[51] Int. Cl.[4] ..... H01R 9/08

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 3,824,527 | 7/1974 | Evans | 339/97 R |
| 4,283,103 | 8/1981 | Forberg et al. | 339/59 M |
| 4,381,132 | 4/1983 | Tournier | 339/99 R |
| 4,429,940 | 2/1984 | Freshwater et al. | 339/99 R |

*Primary Examiner*—Joseph H. McGlynn

*Attorney, Agent, or Firm*—Baker, Maxham, Callan & Jester

[57] ABSTRACT

Terminal elements for interconnecting insulated wires. Twin-contact terminal elements are formed of leaf-shaped sides of resilient contact material, each side having a slot for solderless, screwless and stripless clamping contact with an individual wire. The terminal elements are V-shaped, a plurality of which can be mounted in an insulative terminal strip so that each two adjacent terminal elements are disposed with their sides in parallel confronting relationship.

7 Claims, 7 Drawing Figures

DEVICE FOR CONNECTING INSULATED WIRES TO TWIN-TERMINAL CONTACT ELEMENTS

CROSS REFERENCE TO RELATED APPLICATION

This is a continuation-in-part of U.S. patent application Ser.. No. 235,432, filed Feb. 17, 1981, now abandoned.

FIELD OF THE INVENTION

The invention relates generally to devices for connecting insulated wires to terminal elements and more particularly to solderless, screwless and stripless terminals for interconnecting two or more wires.

DISCUSSION OF THE PRIOR ART

Solderless, screwless and stripless clamping connectors with twin contact members for the connection of two adjacent telecommunications cable conductors or jumper wires are known in various embodiments. As an example, German Pat. No. 2 142 850 shows an electrical clamping device for connecting one or more insulated wires to a terminal element with at least two slots. Another example is German Pat. No. 1 765 584 which shows a clamping connection between one or two insulated wires and a terminal element with two slots, each consisting of two contact arms resilient relative to one another and suited to penetrate the wire insulation. These clamping connectors have disadvantages in that when a plurality of them are mounted in terminal strips they require modifications causing additional manufacturing expenses. They also use significant terminal strip space in the case of side-by-side arrangement.

A V-shaped terminal having two slots, one slot thereof serving to retain and the other one serving to contact the conductor, is shown in U.S. Pat. No. 3,824,527. Each of the slots of that terminal is constructed differently. Additionally, much space is required when a plurality of those terminals are mounted in terminal strips. Further, one terminal having two slots accommodates only a single wire.

In all of the above examples, the wire enters the slot substantially perpendicular with the plane of the contact. When several are mounted together side-by-side in a terminal strip, considerable space is necessary.

Another example is the device shown in U.S. Pat. No. 4,283,103 where slotted terminals are arranged at a 45° angle with respect to the axis of the wire to be connected. In that terminal, each side of the slot is free to move unless positively supported within the terminal strip. Each terminal connects with a single wire.

SUMMARY OF THE INVENTION

Broadly speaking, this invention provides terminal elements mounted in a terminal strip in such a way as to reduce costs and space requirements, while interconnecting two insulated wires in parallel fashion.

Each terminal element has two planar arms or sides interconnected in a V-shaped configuration, each side receiving an individual wire in a slot. A plurality of these terminal elements are mounted side-by-side in an insulative terminal strip with their sides arranged in a parallel confronting manner to conserve longitudinal space in the terminal strip. The inner edges of each side of the V-shaped terminal element are interconnected and therefore self supporting and rigid. The outer edges are supported by the terminal strip.

Thus a relatively inexpensive but rigid terminal element is formed to make positive electrical and mechanical contact with two insulated wires in parallel relationship without adverse stresses on the terminal element.

BRIEF DESCRIPTION OF THE DRAWING

The objects, advantages and features of this invention will be more apparent from the following detailed description when read with reference to the accompanying drawing in which.

DESCRIPTION OF THE PREFERRED EMBODIMENTS

Figure 1:
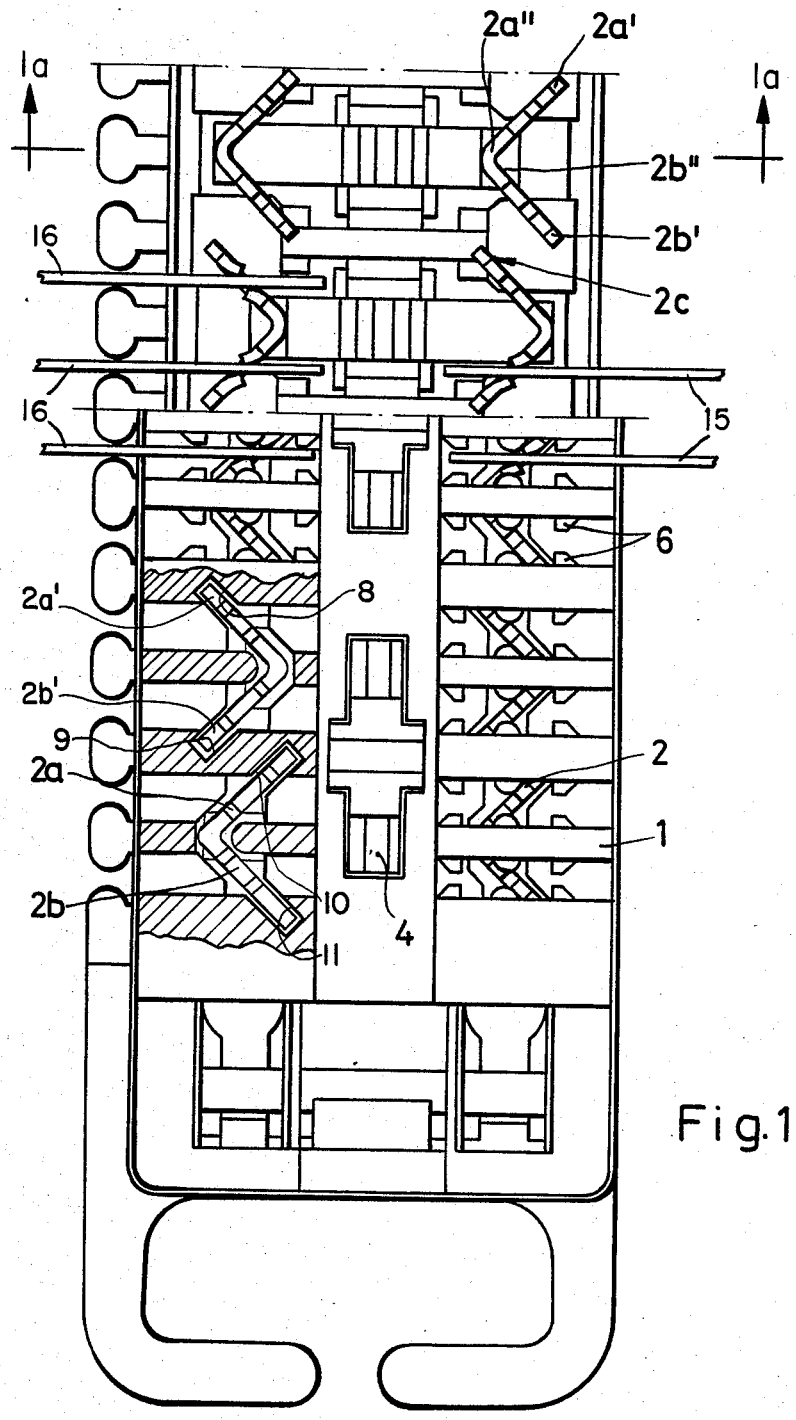
FIG. 1 is a partially cut away plan view of a terminal strip showing the relative positions of the V-shaped terminal elements of the invention.

With reference now to the drawing, terminal elements 2 are shown as V-shaped twin contact members. Each individual arm or side 2*a*, 2*b* of the terminal element 2 forms a solderless, screwless and stripless contact member. These are of the well-known LSA-PLUS type, where an insulated wire 15, 16 is inserted in slots 21, 22 in either arm at a 45° angle with respect to the plane of the arm. An enlarged tapered opening is provided to facilitate proper location and entry of the wire into the slot. The inside edges of each arm 2*a*'', 2*b*'' are interconnected at the apex of the V, and the outer edges 2*a*', 2*b*'' are supported in grooves 8, 9, 10, 11 in the terminal strip. Upon entry of the wire into the slot an opposite direction torquing will occur at the edges of the slot and the sharp edges will penetrate the wire insulation and contact the central conductor. Enlarged relief openings 25, 26 are formed below the slots to enhance the torquing effect when a wire is inserted.

Figure 1A:
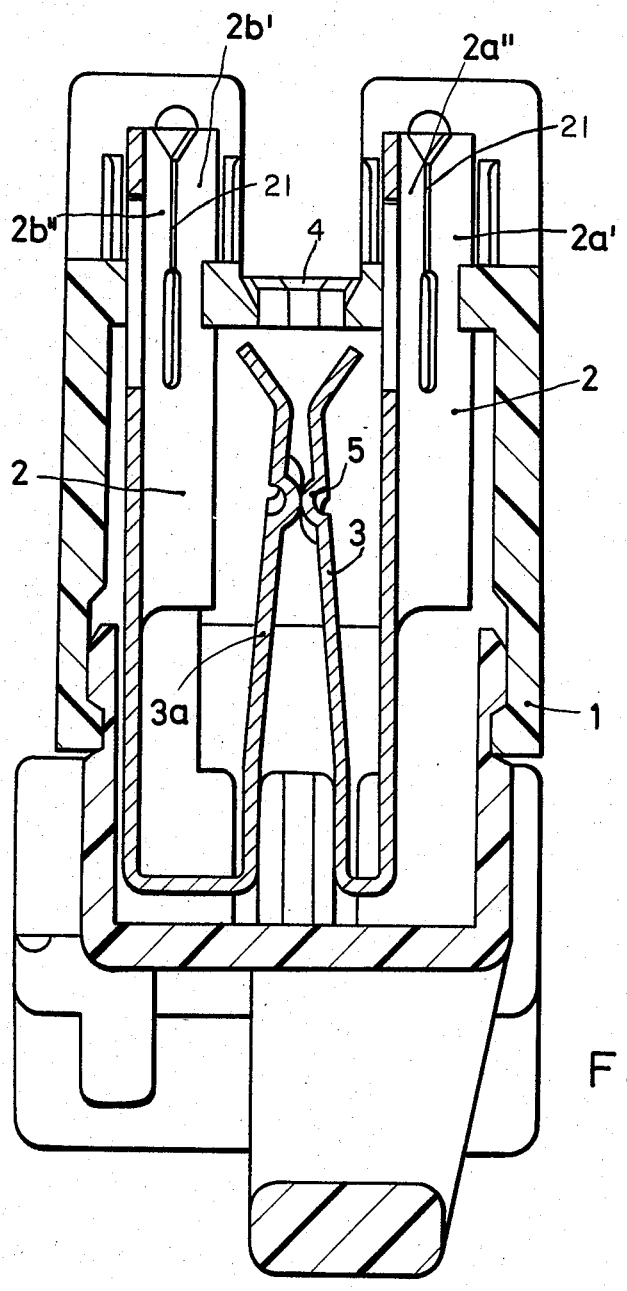
FIG. 1*a* is a cross-sectional view of the device of FIG. 1 taken along line 1*a*—1*a* and showing the terminal elements of FIGS. 3 and 4.
Figure 2:
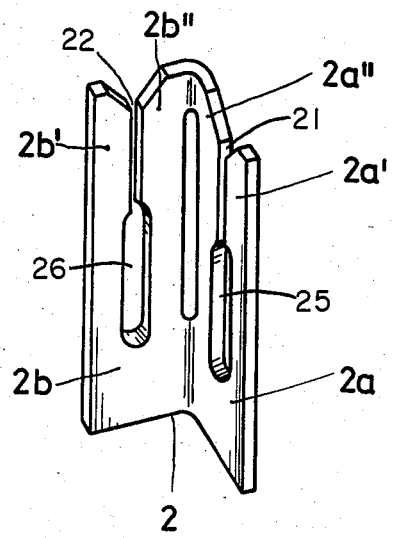
FIG. 2 shows an embodiment of a terminal element as a simple V-shaped twin contact member.
Figure 3:
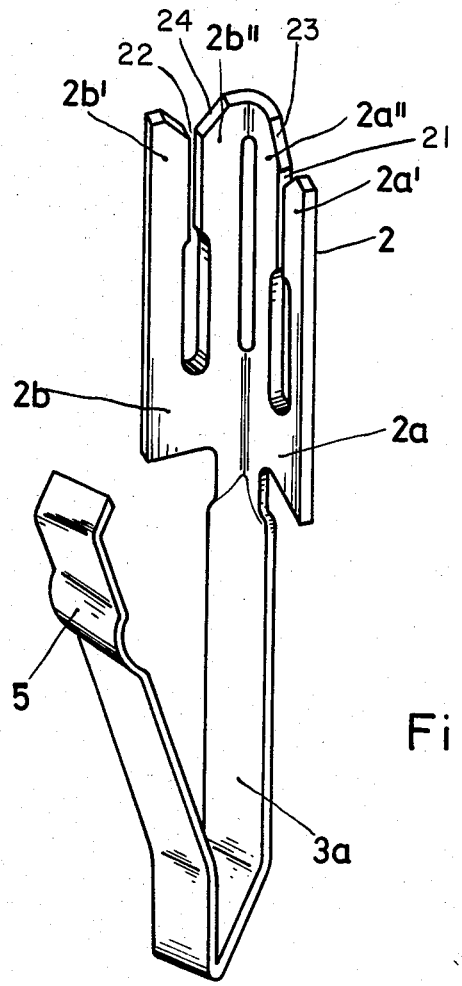
FIG. 3 is a preferred embodiment of the terminal element as shown in FIG. 1*a;*
Figure 4:
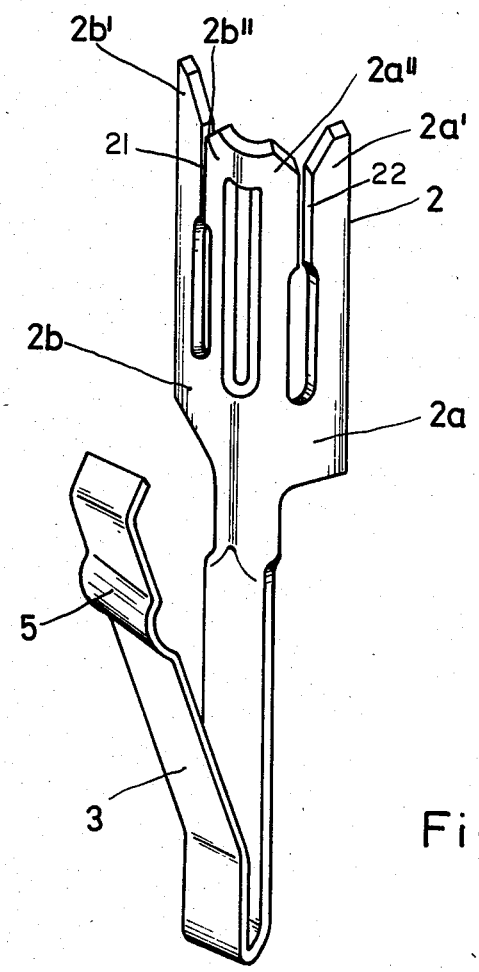
FIG. 4 is a terminal element corresponding to FIG. 3 of reversed V-shape.

As shown in FIG. 1, the terminal elements are mounted longitudinally in terminal strip 1. Advantageously, the angular surfaces 2*c* of two adjacent terminal elements 2 are disposed in parallel opposite relationship. Two mating terminal elements of FIGS. 3 and 4 are shown in FIGS. 1 and 1*a* mounted in the terminal strip. Note that the two terminal elements alternate as they are inserted into the terminal strip so that each has one side parallel with a side of the next adjacent element. This facilitates efficient use of space with respect to the length of the terminal strip.

The terminal elements shown in FIGS. 1*a*, 3, 4, 5 and 6 have extensions 3, 3*a* below the contact portion. In terminal elements 2 of FIGS. 3 and 4 the extensions 3, 3*a* are disconnectable normally-closed contacts, which, as is known, may be disconnected by an insulative disconnecting plug (not shown), which may be inserted through the opening 4 of the terminal strip 1 so as to disconnect contact bights 5 of the extensions.

Ribs 6 (FIG. 1), in addition to grooves 8–11, provide support for the outer edges of terminal element sides 2a', 2b' when and after a wire is inserted into the slot, as well as being a guide for the wire itself. Further, each pocket in the terminal strip for receiving a terminal element is substantially rectangular and has a slotted structure which confines and supports the outer edges of the elements. During the contacting operation, the two outer contact arms 2a', 2b' of a terminal element are supported by the insulating body of the terminal strip 1 with the two inner arms 2a'', 2b'' supporting one another as stated above.

Figure 5:
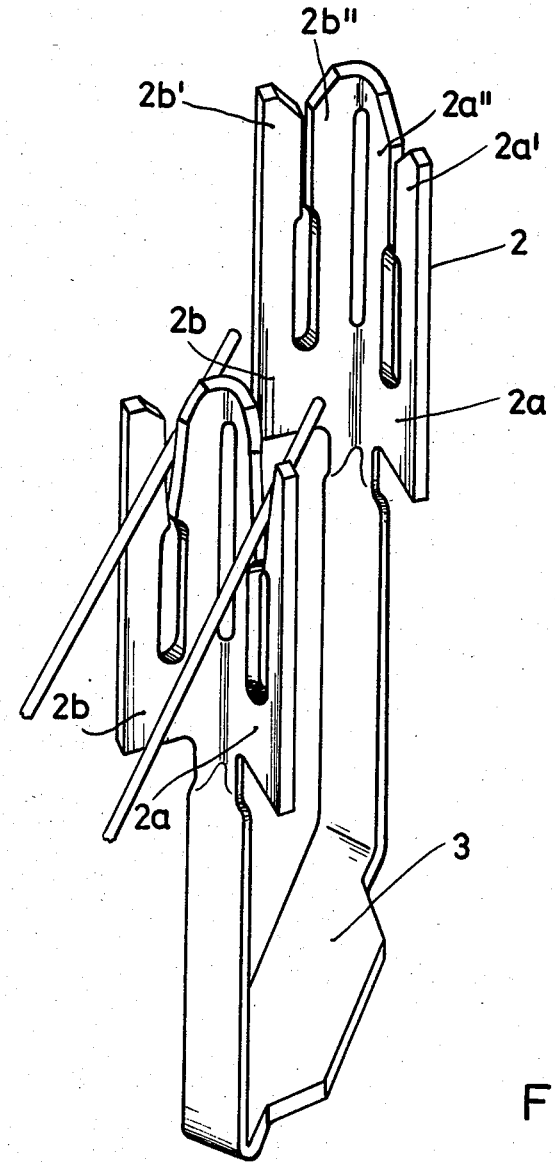
FIG. 5 shows an alternative embodiment dual terminal element.

FIG. 5 shows an alternative terminal element having a pair of twin contact members or sides 2a, 2b with an extension 3 forming a cross connection between them. With this embodiment a total of four conductors may be connected to the same element, two on each side of the terminal strip.

Figure 6:
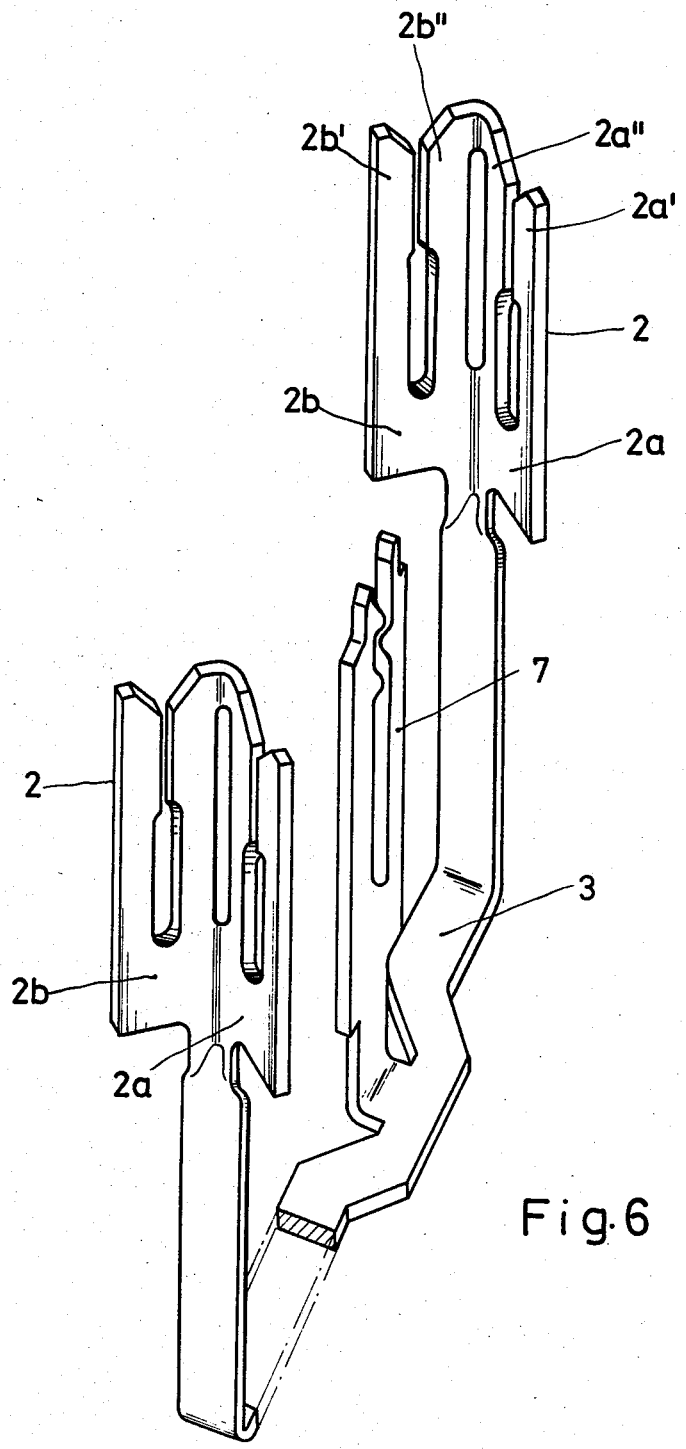
FIG. 6 shows a terminal element corresponding to FIG. 5 with a central tap contact.

FIG. 6 also shows another terminal element for four conductors, corresponding to FIG. 5, with a center tap contact member 7. This center contact would typically be used to connect to a surge arrester which, in a separate stack arrangement somewhat similar in configuration to the terminal strip, mounts on top of strip 1 and has contact members extending into openings 4.

The structure shown and described provides a relatively inexpensive terminal element which, with its internal longitudinal support (the V-shape) and external support by the terminal strip grooves, is quite rigid when subjected to the forces associated with inserting and retaining a wire. The longitudinal interconnection of the arms at the apex of the V provides substantial longitudinal rigidity for the terminal. Even though slots 21, 22 together with relief openings 25, 26 are more than half the length of arms 2a, 2b, support for outer arms 2a', 2b' provided by the terminal strip grooves is adequate to prevent relative movement of the outer arms with respect to the inner arms upon insertion of a wire 15, 16.

When a wire is inserted into a slot 21, there is a relative torque on the facing edges of the slot. Also a net torque will result on the terminal with only one wire connected to it. However, with the V-shaped configuration and two parallel wires as shown in FIG. 1, opposite and equal torques are applied to terminal element 2, resulting in a net zero torque on the element. It is also important to observe that each of the two slots are independent and the insertion of a wire into one has no effect on the other arm of the terminal element.

Another advantage of the V-shape, already mentioned, is that when the elements are mounted in the terminal strip in alternating fashion the parallel arms of adjacent elements can be rather closely spaced, thus conserving terminal strip space and allowing a greater number of wire terminations in the same terminal strip length. Another factor contributing to space conservation is that because of the self support provided by the V-shape, less structure is needed in the terminal strip to support the terminal element.

In view of the above description, it is likely that modifications and improvements will occur to those skilled in the art which are within the scope of the appended claims.

What is claimed is:

1. A terminal element for connecting to insulated wires, said terminal element comprising:

a V-shaped member formed of resilient electrical contact material, each side of said V-shaped member being shaped and configured with a slot opening into one edge thereof, said slot being defined by closely spaced sharp edges;

an entry opening in each side of said V-shaped member, said opening communicating with said slot and having a width greater than the width of said slot, said slot having a width narrower than the thickness of the conductor portion of a wire to which said terminal element is adapted to connect;

said sides of said V-shaped member being oriented at an angle of 45° with respect to the axis of the wire so that the confronting edges of said slot torque with respect to each other upon forced entry of the wire into said slot, whereby the sharp edges of said slot cut through the insulation of the wire to establish electrical connection between the conductor portion of the wire and said terminal member, the torque on one side of said V-shaped member being in the opposite direction to the torque on the opposite side when two of said wires are inserted into said member;

adjacent ones of said V-shaped members being adapted to be longitudinally mounted to an electrically insulated terminal strip in at least one row, the apex of each V-shaped terminal element being oriented in opposite directions for each two adjacent terminal elements so that the more closely adjacent V-shaped member sides are arranged in spaced confronting parallel relationship;

each said V-shaped member being adapted to receive two of said insulated wires, one in each slot in each side of said member.

2. The terminal element recited in claim 1 and further comprising an extension projecting from said V-shaped member in a direction away from said one edge, said extension being shaped and configured so that when two said V-shaped members are mounted on opposite sides of a terminal strip said extensions form normally closed disconnectable contacts to electrically interconnect said V-shaped members.

3. The terminal element recited in claim 1 and further comprising an extension projecting from said V-shaped member in a direction away from said one edge, two of said extensions being integrally connected to thereby interconnect two V-shaped members, the composite terminal element having four said slots, each being adapted to receive a single one of said wires.

4. The terminal element recited in claim 3 wherein said interconnecting extension further comprises a tap contact external connection.

5. A terminal strip shaped and configured to receive a multiplicity of terminal elements arranged in at least one row of adjacent terminal elements, said terminal elements being adapted for interconnection to insulated wires, each said terminal element comprising:

a V-shaped member formed of resilient electrical contact material, each side of said V-shaped member being shaped and configured with a slot opening into one edge thereof, said slot being defined by closely spaced sharp edges;

an entry opening in each side of said V-shaped member, said opening communicating with said slot and having a width greater than the width of said slot, said slot having a width narrower than the thickness of the conductor portion of a wire to which said terminal element is adapted to connect;

said sides of said V-shaped member being oriented at an angle 45° with respect to the axis of the wire so that the confronting edges of said slot torque with respect to each other upon forced entry of the wire into said slot, whereby the sharp edges of said slot cut through the insulation of the wire to establish electrical connection between the conductor portion of the wire and said terminal member, the torque on one side of said V-shaped member being in the opposite direction to the torque on the opposite side when two of said wires are inserted into said member;

adjacent ones of said V-shaped members being adapted to be longitudinally mounted to said terminal strip in at least one row, the apex of each V-shaped terminal element being oriented in opposite directions for each two adjacent terminal element so that the more closely adjacent V-shaped member sides are arranged in spaced confronting parallel relationship;

each said V-shaped member being adapted to receive two of said insulated wires, one in each slot in each side of said member.

6. A terminal element adapted to connect to insulated wires, said terminal element comprising:

a V-shaped contact member, each side thereof being formed with an inner and an outer contact arm having juxtaposed confronting edges forming a slot therebetween, said slot opening into one edge of said V-shaped member, said edges of said juxtaposed contact arms defining said slot being relatively sharp;

an entry opening in each side of said V-shaped member, said entry opening being wider than and communicating with said slot, said slot being narrower than the diameter of the conductor portion of a wire to which said terminal is adapted to connect;

said V-shaped member being integrally formed of a resilient electrically conductive material with said inner arms being connected at the common apex of said V for mutual self-support, said inner and outer arms being interconnected at the bottom of said slots to form a unitary terminal;

said sides of said V-shaped member being oriented at an angle of 45° with respect to the axis of the wire so that the confronting edges of said inner and outer arms torque with respect to each other upon forced entry of the wire into said slot, whereby the sharp edges of said arms sever the wire insulation to establish electrical contact between the conductor portion of the wire and said terminal member;

each of said slots being adapted to receive a separate wire, the torque on said inner arms being in opposite directions when a wire is inserted in each of the two slots in said terminal, whereby the net torque on said terminal from two connected wires is zero;

a plurality of said V-shaped members being adapted to be mounted to a terminal strip in mutually adjacent relationship in at least one row, the apex of each V-shaped terminal element being oriented in opposite directions for each two adjacent terminal elements, each two adjacent terminal elements having their more closely adjacent sides arranged in confronting spaced parallel relationship.

7. A terminal strip shaped and configured for interconnection to a multiplicity of insulated wires, said terminal strip comprising:

a multiplicity of terminal elements, each said terminal ement comprising:

a V-shaped contact member, each side thereof being formed with an inner and an outer contact arm having juxtaposed confronting edges forming a slot therebetween, said slot opening into one edge of said V-shaped member, said edges of said juxtaposed contact arms defining said slot being relatively sharp;

an entry opening in each side of said V-shaped member, said entry opening being wider than and communicating with said slot, said slot being narrower than the diameter of the conductor portion of a wire to which said terminal is adapted to connect;

said V-shaped member being integrally formed of a resilient electrically conductive material with said inner arms being connected at the common apex of said V for mutual self-support, said inner and outer arms being interconnected at the bottom of said slots to form a unitary terminal;

said sides of said V-shaped member being oriented at an angle of 45° with respect to the axis of the wire so that the confronting edges of said inner and outer arms torque with respect to each other upon forced entry of the wire into said slot, whereby the sharp edges of said arms sever the wire insulation to establish electrical contact between the conductor portion of the wire and said terminal member;

each of said slots being adapted to receive a separate wire, the torque on said inner arms being in opposite directions when a wire is inserted in each of the two slots in said terminal, whereby the net torque on said terminal from two connected wires is zero;

an electrically insulative housing, said housing being shaped and configured to receive said V-shaped members in adjacent relationship in at least one row, the apex of each V-shaped terminal element being oriented in opposite directions for each two adjacent terminal elements, each two adjacent terminal elements having their more closely adjacent sides arranged in confronting parallel relationship;

said terminal strip having means for supporting the outer edges of said outer arms of said V-shaped member to prevent motion of said outer edge upon insertion of a wire into said slots, there being a torquing action only between the confronting edges of the arms defining said slots.

* * * * *